US006997749B1

(12) United States Patent
Harubayashi

(10) Patent No.: US 6,997,749 B1
(45) Date of Patent: Feb. 14, 2006

(54) SHIELD CONNECTOR

(75) Inventor: Nobuaki Harubayashi, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/191,084

(22) Filed: Jul. 28, 2005

(30) Foreign Application Priority Data

Aug. 9, 2004 (JP) ..... 2004-232568

(51) Int. Cl.
*H01R 13/648* (2006.01)

(52) U.S. Cl. ..... 439/607; 439/353; 439/358

(58) Field of Classification Search ..... 439/607, 439/353, 357, 358, 610
See application file for complete search history.

(56) References Cited

U.S. PATENT DOCUMENTS 5,380,223 A * 1/1995 Marsh et al. ..... 439/610
5,584,718 A * 12/1996 Sukegawa ..... 439/352
6,257,914 B1 * 7/2001 Comerci et al. ..... 439/357
6,290,530 B1 * 9/2001 Chang ..... 439/378
6,595,801 B1 * 7/2003 Gardner et al. ..... 439/607
6,607,397 B1 * 8/2003 Zhang et al. ..... 439/357
6,902,432 B2 * 6/2005 Morikawa et al. ..... 439/607

FOREIGN PATENT DOCUMENTS

JP 2000-133386 5/2000

* cited by examiner

*Primary Examiner*—Tho D. Ta
(74) *Attorney, Agent, or Firm*—Takeuchi & Kubotera, LLP

(57) ABSTRACT

The connector engaging portion (A-1) of the cable side connector (A) is inserted into the shield outer cylindrical portion (21) of the shield member (2). The engaging projection (10) engages the engaging hole (26), and the guide groove portion (11) is inserted into the guide (21A). The contact terminals (41) are attached to the terminal attaching portions (5) of the connector housing 1, so that the contact terminals (41) engage the lances (8). Accordingly, the exposed portion (1B) of the connector housing (1) protrudes from the end of the shield outer cylindrical portion (21), so that the exposed portion (1B) and the shield outer cylindrical portion (21) constitute the connector engaging portion (A-1).

9 Claims, 12 Drawing Sheets

SHIELD CONNECTOR

TECHNICAL FIELD

The present invention relates to a shield connector for connecting shield cables of electrical devices installed in an automobile and the like.

BACKGROUND TECHNOLOGY

Patent Reference 1 has disclosed such a type of conventional shield connector. As shown in FIG. 22, a cable side connector of the shield connector is formed of a connector housing 70, a terminal unit 72 connected to a shield cable 71, and a retainer 73.

The connector housing 70 is provided with a terminal attaching portion 74 on a front surface portion thereof and a cable insertion portion 75 at a rear side thereof, respectively. A lock portion (not shown) is provided outside the connector housing 70.

The terminal unit 72 is formed of an insulating block 78 having a plurality of contact attaching hole portions 78*a*; a shield member 79; a shield cover 80; and a plurality of contacts (not shown). The contacts are connected to end portions of a plurality of core wires of the shield cable 71. The contacts are connected to the contact attaching hole portions 78*a* of the insulating block 78.

The terminal unit 72 is inserted and fixed to the terminal attaching portion 74 from a side of the cable insertion portion 75 of the connector housing 70. The shield cable 71 is laid along the cable insertion portion 75. In this state, the retainer 73 covers the cable insertion portion 75. The retainer 73 holds the terminal unit 72 from behind. The terminal unit 72 covered with the shield member 79 is inserted into the connector housing 70, thereby constituting an engaging portion of a mating connector.

[Patent Reference 1] Japanese Patent Publication No. 2000-133386

The cable side connector of the conventional shield connector includes the terminal unit 72 connected to the shield cable 71; the shield member 79 and the shield cover 80 covering the terminal unit 72; the connector housing 70 receiving and engaging the terminal unit 72; and the retainer 73 fixed to the connector housing 70 for holding the terminal unit 72 from behind. The terminal unit 72 covered with the shield member 79 is inserted into the connector housing 70 to constitute the engaging portion of the mating connector. The lock portion is provided outside the connector housing. Accordingly, a whole size of the cable side connector tends to increase.

SUMMARY OF THE INVENTION

In view of the problems described above, an object of the present invention is to provide a shield connector with a small number of parts, in which it is possible to reduce a size of a connector housing, thereby making it possible to reduce a size of the shield connector.

In order to attain the objects described above, according to the present invention, a shield connector comprises a connector housing having a contact terminal for contacting with a mating side terminal of a mating connector when a connector engaging portion is detachably engaged with a mating side engaging portion of the mating connector; and a contact terminal. A shield member has a shield outer cylindrical portion. The connector housing has a shield attaching portion and lock means. When the shield attaching portion is inserted into the shield outer cylindrical portion, the connector housing is attached to the shield member to form the connector engaging portion. When connected to the mating connector, the lock means is detachably engaged with a lock portion of the mating connector.

With the configuration described above, when the shield attaching portion is inserted into the shield outer cylindrical portion, the connector housing is attached to the shield member to form the connector engaging portion. Further, the connector housing is provided with the lock means. Accordingly, as compared with the conventional connector in which the terminal unit covered with the shield is inserted into the connector housing to constitute the mating connector side engaging portion, it is possible to reduce the number of parts and a size of the connector housing, thereby making it possible to reduce a whole size of the shield connector.

According to the present invention, in the shield connector described above, the shield member includes the shield outer cylindrical portion and a cable side shield portion for covering an end portion of a cable to be connected to the contact terminal. A case and a retainer cover the cable side shield portion.

With the configuration described above, the cable side shield portion is covered with the case and the retainer. Accordingly, it is possible to contribute to complete fixing of the case side shield portion to the case and reinforcement of a fixing force relative to a tensile force of the cable.

According to the present invention, in the shield connector described above, the case is provided with a lock lever insertion opening and a pair of projections disposed at an entrance side of the lever insertion opening. The lock means is provided with a lock lever with a cantilever shape. When the connector housing is attached to the shield member, the lock lever is inserted into the lock lever insertion opening and the projections are positioned at both sides of the lock lever. When connected to the mating connector, the projections are inserted into the mating connector side engaging portion to abut against an inner surface of the mating connector side engaging portion.

With the configuration described above, when the connector housing is attached to the shield member, the lock lever is inserted into the lock lever insertion opening. Accordingly, it is possible to insert the shield member of the connector housing into the shield outer cylindrical portion. Therefore, it is possible to make the connector housing small and reduce a whole size of the shield connector. When connected to the mating connector, if the connector is twisted, the lock lever may be deformed. However, since the projections are positioned at the both sides of the lock lever, the projections abut against the inner surface of the mating connector side engaging portion, and it is possible to prevent the lock lever from being deformed.

According to the present invention, in the shield connector described above, the shield attaching portion is attached to the shield outer cylindrical portion. The contact terminal is attached to the terminal attaching portion of the connector housing. The shield member is attached to the connector housing. The shield member is formed of a shield portion; a cover portion; a bent portion at a middle portion between the shield portion and the cover portion; and a pressing portion connected to the cover portion. The case includes a case side shield engaging recess portion and a retainer engaging portion. The retainer includes a retainer side shield engaging recess portion. In a state that the shield cable is retained in the cover portion, the pressing portion presses so that the shield cable is attached to the shield member. The bent portion is bent together with the shield cable by substantially right angle relative to the shield outer cylindrical portion to engage the cover portion with the shield outer cylindrical portion. The cable side shield portion engages the case side shield engaging recess portion. The retainer engages the case, so that the cable side shield portion is held with the retainer.

With the configuration described above, as compared with the conventional connector in which the terminal unit covered with the shield is inserted into the connector housing to constitute the mating connector side engaging portion, it is possible to reduce the number of parts and a size of the connector housing, thereby making it possible to reduce a whole size of the shield connector.

According to the present invention, in the shield connector described above, the mating connector includes an insulating housing and a shield case covering the insulating housing. The mating connector side engaging portion is disposed inside the insulating housing. The insulating housing includes shield piece insertion openings formed in opposite surfaces thereof facing to each other. The shield case has a box shape. Shield contacting portions protruding inside the shield case are formed on the opposite surfaces facing to each other. The shield case covers the insulating housing. The shield contacting portions are inserted into the shield piece insertion openings to protrude into the mating connector side engaging portion, so that a mating side terminal is positioned at the mating connector side engaging portion.

With the configuration described above, when the connector engaging portion engages the mating connector side engaging recess portion to connect both connectors, the shield contacting portions of the shield case contact with the shield outer cylindrical portion of the shield member constituting a connector connecting portion. Accordingly, it is possible to contribute the reduction in a whole size of the shield connector.

According to the present invention, in the shield connector described above, shield terminals are formed on both side surfaces of the shield case in a connector width direction, so that the shield case is directly mounted on a print board with the shield terminals.

With the configuration described above, it is possible to directly mount the shield case on the print board with the shield terminals. Accordingly, it is possible to contribute the reduction in a whole size of the shield connector.

In the shield connector of the invention, the shield attaching portion is attached to the shield outer cylindrical portion, so that the connector housing is attached to the shield member to form the connector engaging portion. Further, the connector housing is provided with the lock means. Accordingly, as compared with the conventional connector in which the terminal unit covered with the shield is inserted into the connector housing to constitute the mating connector side engaging portion, it is possible to reduce the number of parts and a size of the connector housing, thereby making it possible to reduce a whole size of the shield connector.

According to the shield connector of the present invention, when the connector housing is attached to the shield member, the lock lever is inserted into the lock lever insertion opening. Accordingly, it is possible to insert the shield member of the connector housing into the shield outer cylindrical portion. Therefore, it is possible to make the connector housing small and reduce a whole size of the shield connector. When connected to the mating connector, if the connector is twisted, the lock lever may be deformed. However, since the projections are positioned at the both sides of the lock lever, the projections abut against the inner surface of the mating connector side engaging portion, and it is possible to prevent the lock lever from being deformed.

According to the shield connector of the present invention, when the connector engaging portion engages the mating connector side engaging recess portion to connect both connectors, the shield contacting portions of the shield case contact with the shield outer cylindrical portion of the shield member constituting a connector connecting portion. Accordingly, it is possible to contribute the reduction in a whole size of the shield connector.

According to the shield connector of the present invention, it is possible to directly mount the shield case on the print board with the shield terminals. Accordingly, it is possible to contribute the reduction in a whole size of the shield connector.

BRIEF DESCRIPTION OF THE DRAWINGS

FIG. 21-1 is an explanatory view of a state just before the cable side connector is connected to the board side connector;

FIG. 21-2 is an explanatory view of a final state that before the cable side connector is connected to the board side connector.

BEST MODES FOR APPLYING THE INVENTION

Hereunder, embodiments of the present invention will be explained with reference to the accompanying drawings.

Figure 1:
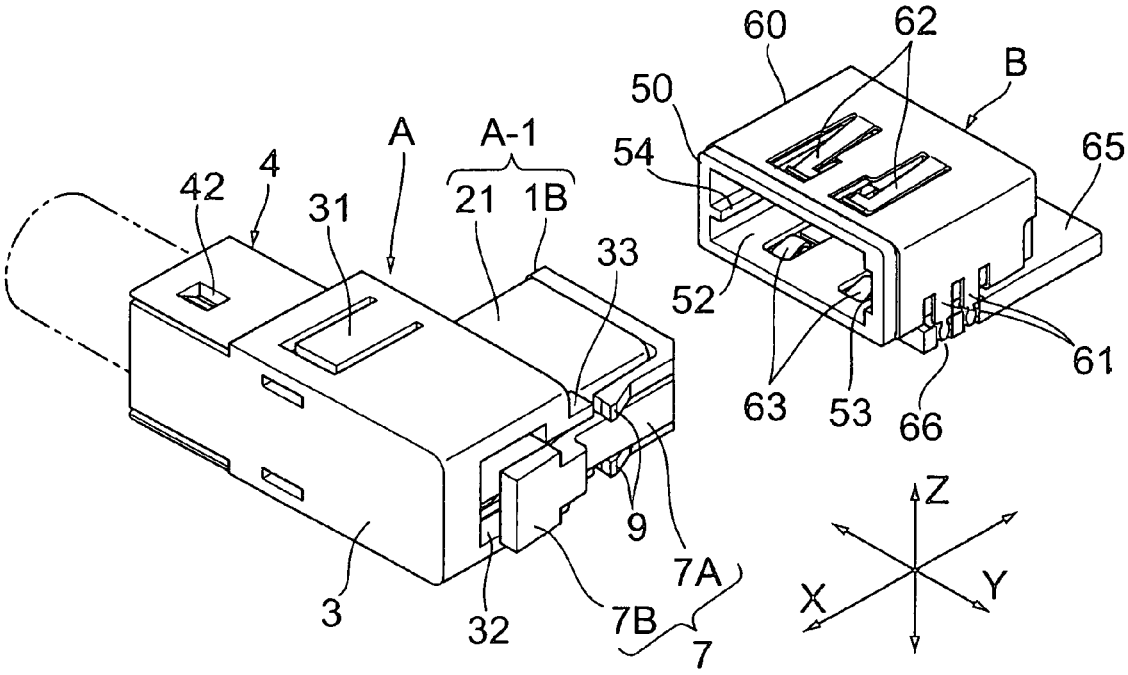
FIG. 1 is an exploded perspective view showing a state before a cable side connector (receptacle connector) is connected to a board side connector (plug connector) in a shield connector of the present invention.
Figure 2:
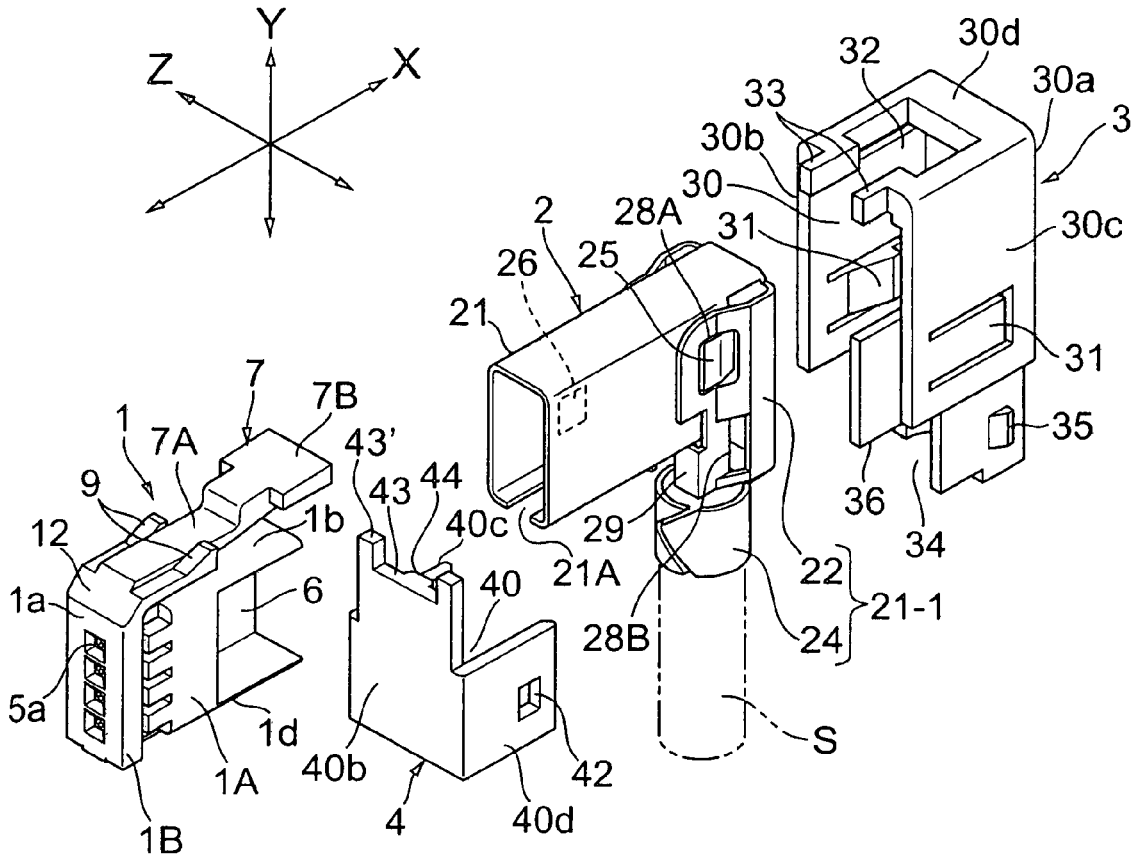
FIG. 2 is an exploded perspective view showing the cable side connector.
Figure 3:
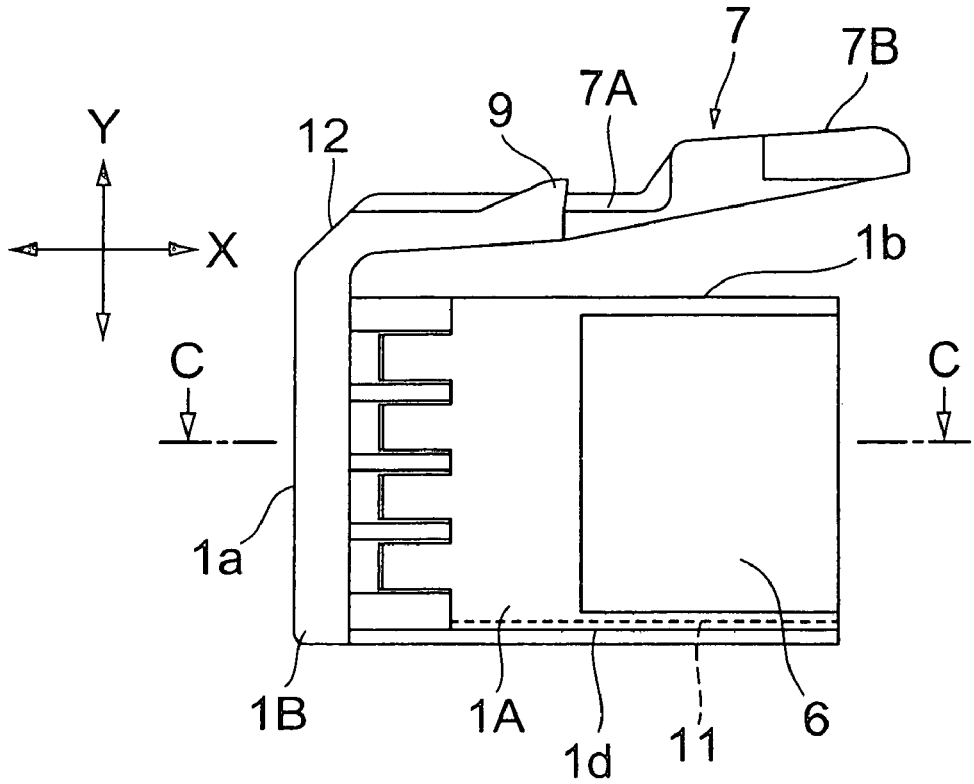
FIG. 3 is a plan view showing a connector housing of the cable side connector.

An embodiment of the present invention is shown in FIGS. 1 to 21. FIG. 1 is an exploded perspective view showing a state before a cable side connector (receptacle connector) is connected to a board side connector (plug connector) in a shield connector of the present invention. FIG. 2 is an exploded perspective view showing the cable side connector. In the figures, X denotes a direction of inserting and pulling out the connector; Y denotes a width direction of the connector; and Z denotes a height direction of the connector.

As shown in FIG. 1, the shield connector of the present invention includes a cable side connector (receptacle connector) A and a board side connector (plug connector) B. As shown in FIG. 2, the cable side connector A is formed of a connector housing 1; a shield member 2; a case 3; a retainer 4; and a plurality of contact terminals 41 (see FIG. 21).

Figure 4:
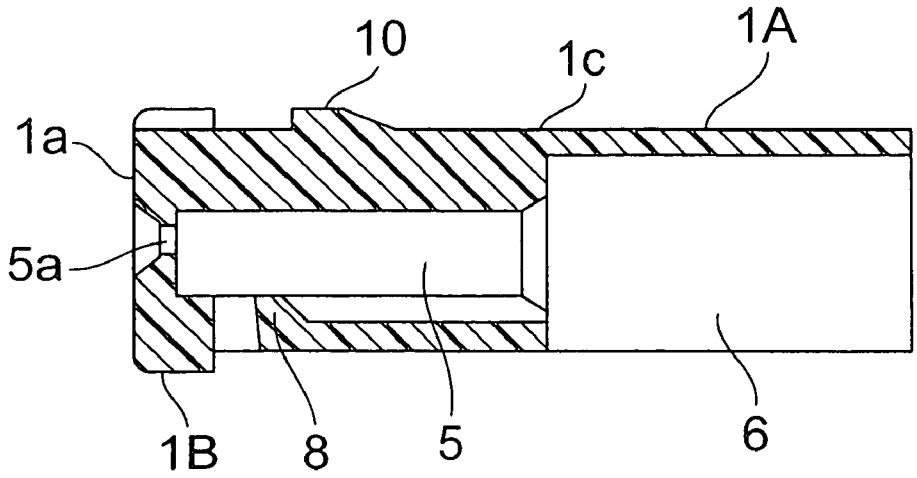
FIG. 4 is a sectional view taken along line C—C in FIG. 3.

As shown in FIG. 2 and FIG. 4, the connector housing includes a shield outer cylindrical attaching portion 1A having a rectangular column shape and an exposed portion 1B having a flange portion formed at an distal end portion of the shield outer cylindrical attaching portion 1A in the connector insertion direction. Further, the shield outer cylindrical attaching portion 1A includes a plurality of terminal attaching portions 5 and a cable insertion portion 6.

A terminal insertion opening 5*a* of the terminal attaching portion 5 opens in a front surface 1*a* (one of end surfaces in the connector insertion direction) of the connector housing 1. As shown in FIG. 4, a lance 8 is formed on a side surface of the terminal attaching portion 5. A rear end of the terminal attaching portion 5 opens toward the cable insertion portion 6.

The exposed portion 1B is provided with a lock portion 7 as lock means. The lock portion 7 includes a lock lever with a cantilever shape. The lock lever 7A extends from a side of the exposed portion 1B toward outside a side surface 1*b* of the connector housing 1 in the connector width direction Y, and is inclined relative to the connector insertion direction X to be apart from the side surface 1*b* toward a distal end thereof. The lock lever 7A is provided with a pushing portion 7B at the distal end thereof and engaging portions 9 at both sides thereof.

An engaging protrusion 10 is formed on one side surface 1*c* of the shield outer cylindrical attaching portion 1A in the connector height direction Z. A guide groove 11 is formed in the other side surface 1*d* of the shield outer cylindrical attaching portion 1A in the connector height direction Z along the connector insertion direction X. A guide portion 12 with an inclined surface is formed at a base portion of the lock lever 7A.

Figure 5:
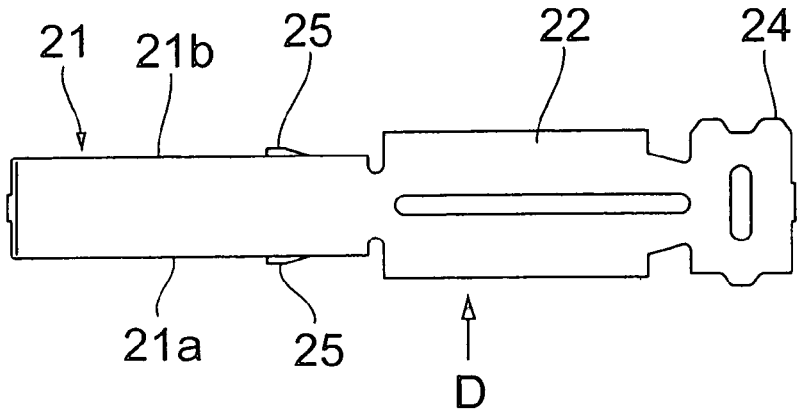
FIG. 5 is a side view showing a shield member in a developed state.
Figure 6:
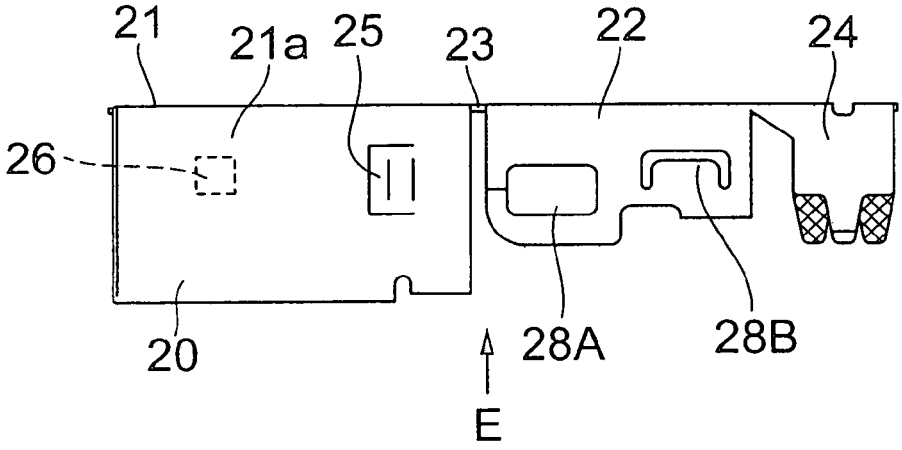
FIG. 6 is a figure viewed from a D direction in FIG. 5.
Figure 7:
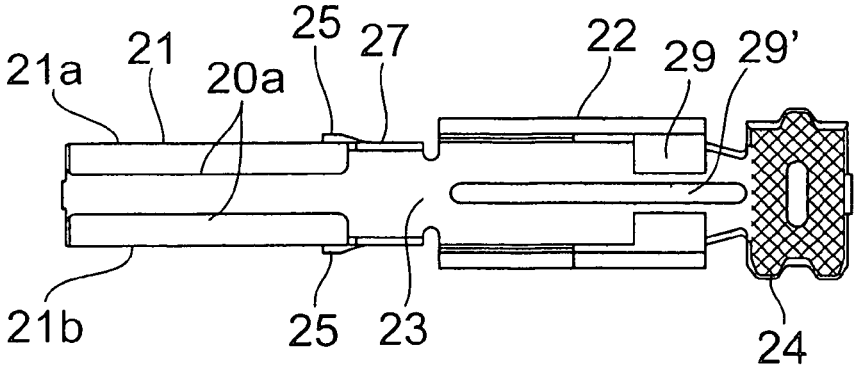
FIG. 7 is a figure viewed from an E direction in FIG. 6.

As shown in FIG. 5 and FIG. 7, the shield member 2 includes a shield outer cylindrical portion 21 formed by bending a metal plate 20 in a rectangular cylinder shape except bent portions 20*a*; a cover portion 22; a bent portion 23 at the middle of the shield outer cylindrical portion 21 and the metal plate 20; and a pressing portion 24 connected to the cover portion 22. The cover portion 22, the bent portion 23 and the pressing portion 24 are formed through bending the metal plate 20. As shown in FIG. 7, a gap is formed between the bent portions 20*a* of the shield outer cylindrical portion 21.

Lances 25 are formed on both side surfaces 21*a* and 21*b* of the shield outer cylindrical portion 21. The side surface 21*a* is provided with an engaging hole 26 and a cover attaching portion 27. The cover portion 22 has a substantially U shape, and includes engaging holes 28A, engaging pieces 28B formed of a cut portion, and a gap 29' formed with bent portions 29 at both side surfaces.

As shown in FIG. 2, a shield cable S is attached to the shield member 2. That is, end portions of a plurality of core cables of the shield cable S are attached to contact terminals 41, respectively. The shield cable S is pressed with the pressing portion 24 in the cover portion 22 and the pressing portion 24 to be attached to the shield member 2. A plurality of contact terminals 41 is inserted into the shield outer cylindrical portion 21.

The cover portion 22 is bent together with the shield cable S at the bent portion 23 by a substantially right angle relative to the shield outer cylindrical portion 21, so that the cover portion 22 is attached to the cover attaching portion 27. The lances 25 engage the engaging holes 28A, so that the cover portion 22 is maintained at the right angle relative to the shield outer cylindrical portion 21 as shown in FIG. 2.

In this case, in the shield member 2, the cover portion 22 and the pressing portion 24 constitute a cable side shield portion 21-1.

Figure 8:
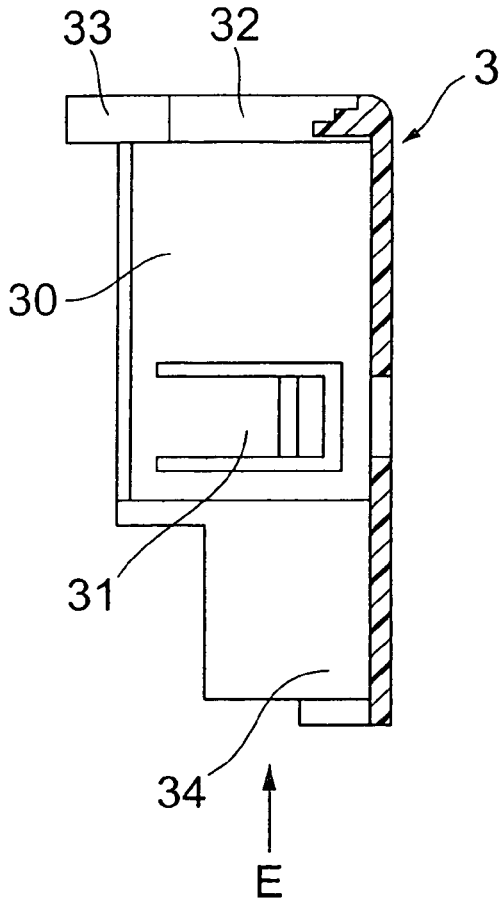
FIG. 8 is a vertical sectional view of a case in the cable side connector.
Figure 9:
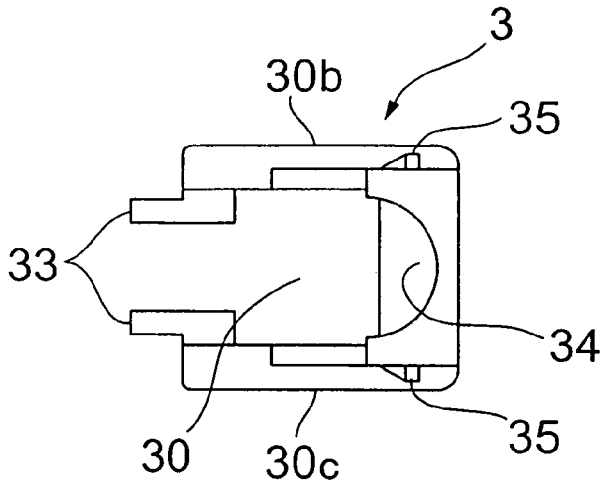
FIG. 9 is a figure viewed from a G direction in FIG. 8.
Figure 10:
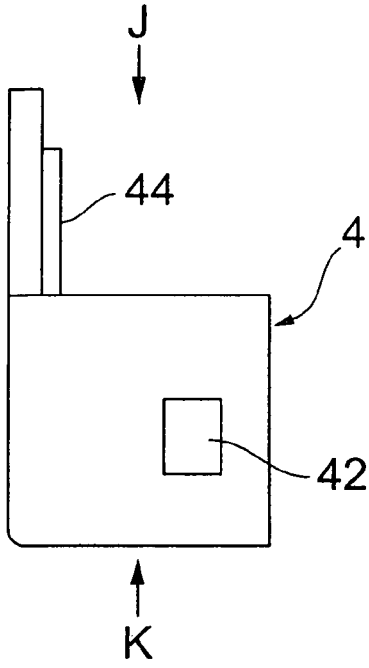
FIG. 10 is a plan view showing a retainer of the cable side connector.
Figure 11:
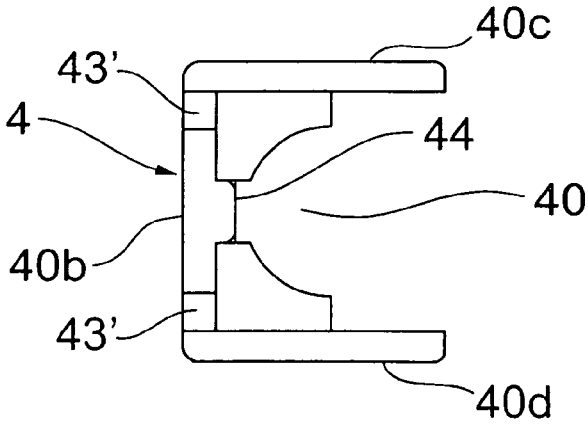
FIG. 11 is a figure viewed from a J direction in FIG. 10.
Figure 12:
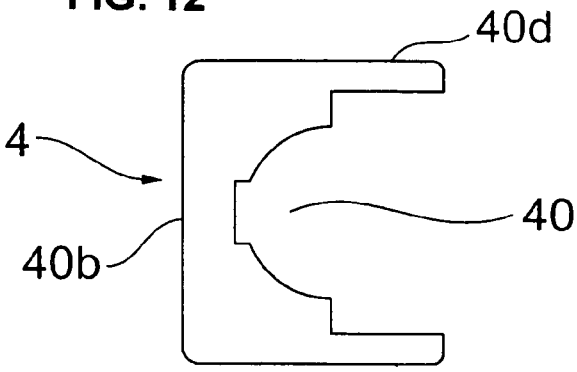
FIG. 12 is a figure viewed from a K direction in FIG. 10.

As shown in FIG. 2 and FIG. 8, the case 3 includes a case side shield engaging projecting portion 30. A lock lever insertion opening 32 is formed at one end side of the case side shield engaging projecting portion 30 in the connector width direction Y, and a retainer engaging portion 34 is provided at the other end side. Lances 31 are formed on both side surfaces 30*b* and 30*c* of the case side shield engaging projecting portion 30.

The lock lever insertion opening 32 is formed in an end wall portion 30*d* of the case 3. A pair of projections 33 is formed at edges of the end wall portion 30*d* to sandwich the lock lever insertion opening 32. Engaging projections 35 are formed on both outer side surfaces of the retainer engaging portion 34.

As shown in FIG. 2, and FIGS. 10 to 12, the retainer 4 includes a retainer side shield engaging projecting portion 40. An engaging portion 43 formed of a cut portion is formed in an edge of an end wall portion 40*b* of the retainer side shield engaging projecting portion 40. Engaging holes 42 are formed in both side wall portions 40*c* and 40*d*. A projection 44 is formed on a backside surface of the end wall portion 40*b*.

A method of assembling the cable side connector will be explained next.

(1) First, the shield cable S provided with a plurality of contact terminals 41 is inserted into the cable insertion portion 6. At the same time, the contact terminals 41 are attached to terminal attaching portions 51, so that the contact terminals 41 engage the lances 8. Then, the shield outer cylindrical attaching portion 1A of the connector housing 1 is fitted in the shield outer cylindrical portion 21 of the shield member 2, so that the engaging projection 10 engages the engaging hole 26. In this case, the exposed portion 1B of the connector housing 1 protrudes from the distal end of the shield outer cylindrical portion 21, so that the exposed portion 1B and the shield outer cylindrical portion 21 constitute a connector engaging portion A-1. The lock lever 7A is situated outside the connector engaging portion A-1. At this time, the cover portion 22 is maintained substantially perpendicular to the connector housing 1, and the shield cable S is pressed with the pressing portion 24.

Next, the case 3 is attached to the shield member 2. That is, the cable side shield portion 21-1 of the shield member 2 engages the case side shield engaging projecting portion 30 of the case 3. The pressing portion 24 of the shield member 2 engages in the retainer engaging portion 34, and the lances 31 engage the engaging portions 28B.

The lock lever 7A of the lock portion 7 is inserted into the lock lever insertion opening 32 of the case 3. The projections 33 projecting from the both side surfaces of the lock lever insertion opening 32 are situated at both sides of the lock lever 7A.

Next, the cable side shield portion 21-1 of the shield member 2 engages the retainer side shield engaging projecting portion 40 and covers the retainer engaging portion 34 of the case 3, so that the engaging projections 35 of the retainer engaging portion 34 engage the engaging holes 42 of the retainer 4. In this case, the projection 44 of the retainer 4 penetrate the gap 29' formed with the bent portions 29 of the shield outer cylindrical portion 21. Also, the engaging portion 43 of the retainer 4 engage the shield outer cylindrical portion 21, so that engaging projections 43' are situated in a gap between the shield outer cylindrical portion 21 and the case 3. Accordingly, strength between the shield outer cylindrical portion 21 and the case 3 is increased, and it is possible to contribute to complete fixing of the case side shield portion 21-1 to the case 3 and reinforcement of a fixing force relative to a tensile force of the shield cable S.

Figure 13:
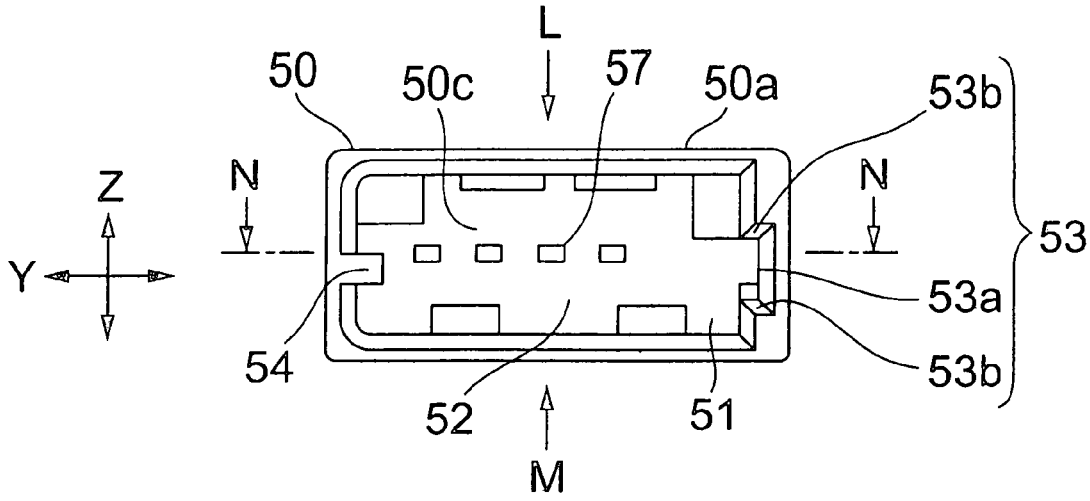
FIG. 13 is a front view showing an insulating housing of the board side connector.
Figures 1, 21:
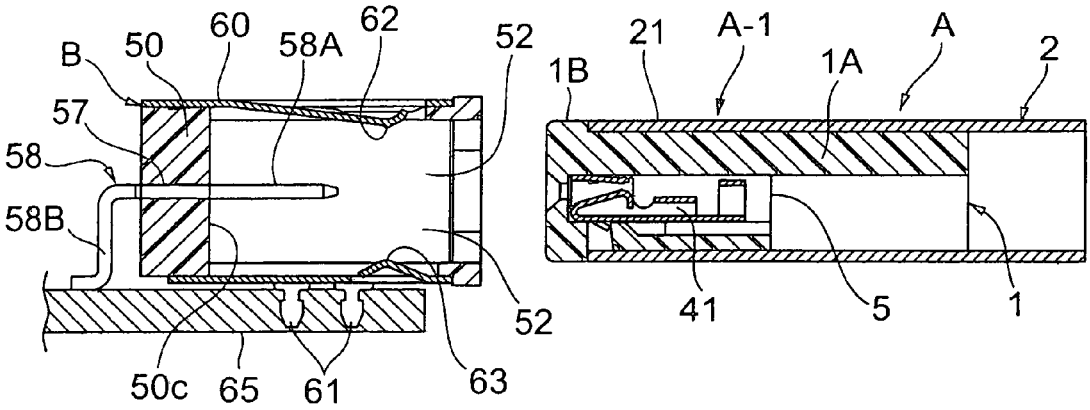
Figures 2, 21:
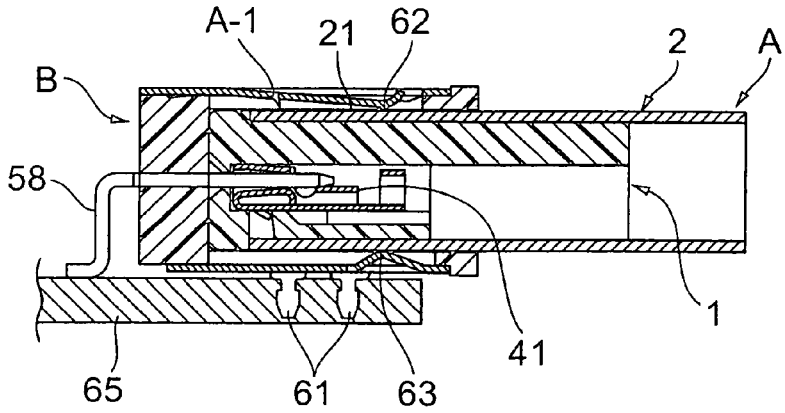
Figure 22:
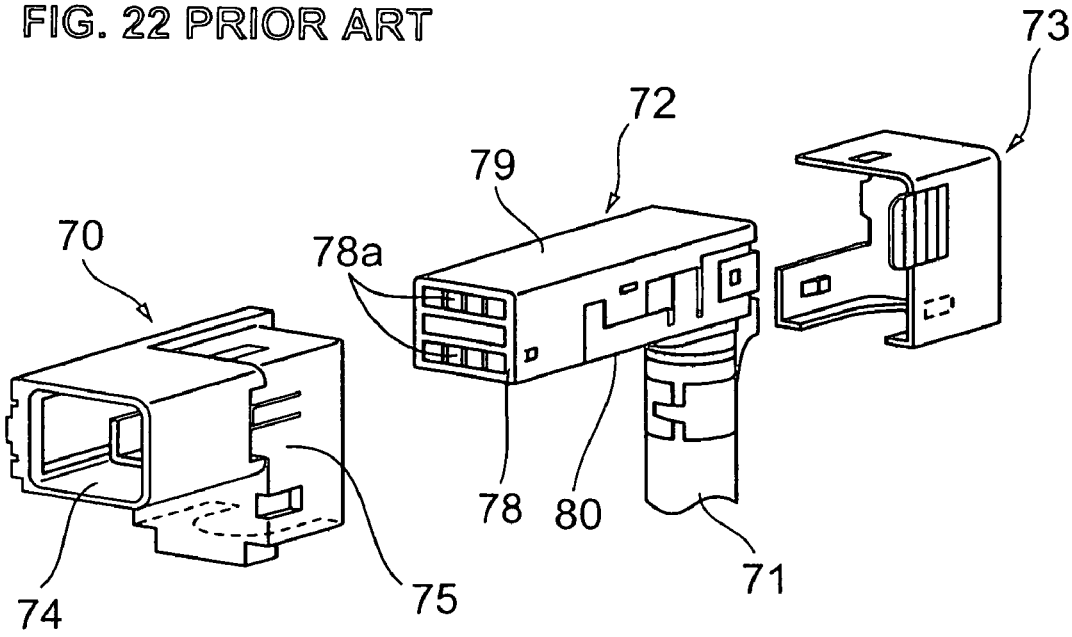
FIG. 22 PRIOR ART
FIG. 22 is an exploded perspective view showing a cable side connector of a conventional shield connector.

The board side connector B as a mating connector includes an insulating housing (plug housing) 50, a shield case 60, and a plurality of mating side terminals 58 (see FIG. 21). As shown in FIG. 13, the insulating housing 50 has a box shape, and an interior thereof from an opening 51 at an one edge surface in the connector insertion direction X constitute a mating connector side engaging portion 52. A lock engaging portion 53 is disposed at one side edge of the opening 51 in the connector width direction Y, and a guide projection 54 is disposed the other side edge, respectively. The lock engaging portion 53 is formed of a guide groove portion 53*a* and engaging portions 53*b* disposed at both sides of the guide groove portion 53*a*.

Figure 14:
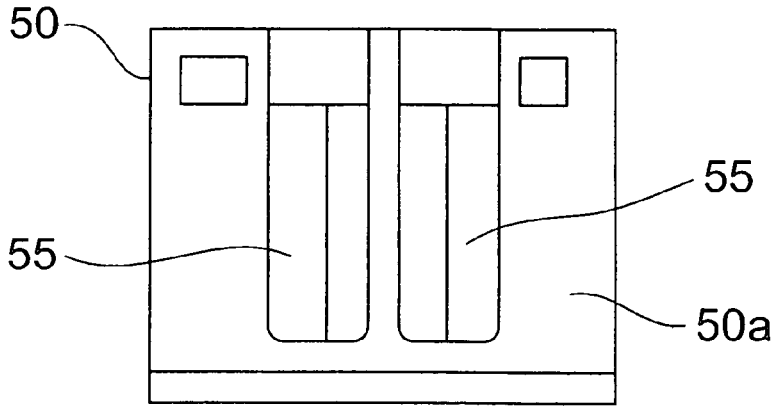
FIG. 14 is a figure viewed from an L direction in FIG. 10.
Figure 15:
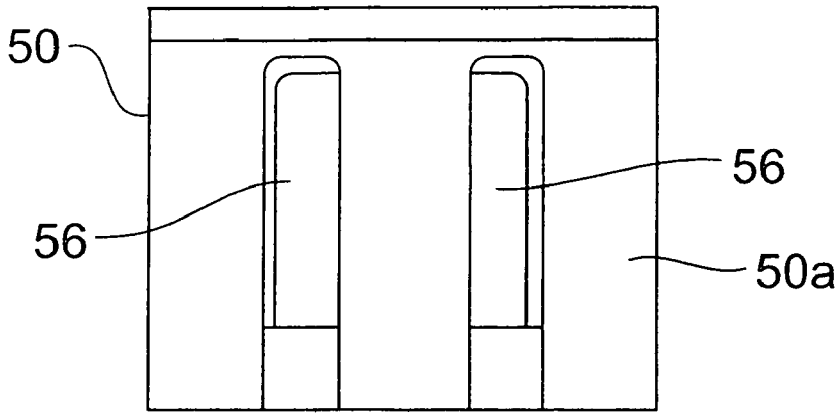
FIG. 15 is a figure viewed from an M direction in FIG. 10.
Figure 16:
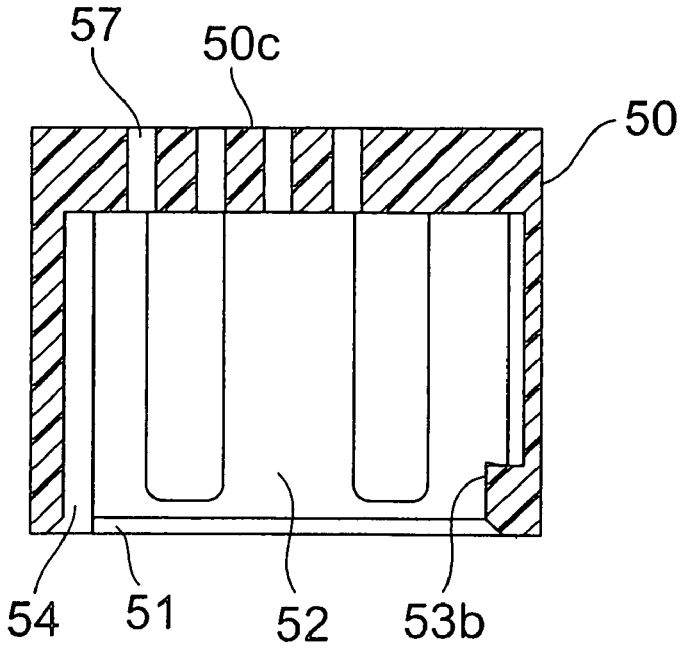
FIG. 16 is a sectional view taken along line N—N in FIG. 13.

As shown in FIG. 14 and FIG. 15, a shield piece insertion opening 55 is formed in one end surface 50*a* of the insulating housing 50 in the connector height direction Z along connector insertion direction X, and a shield piece insertion opening 56 is formed in the other end surface 50*b* along connector insertion direction X, respectively. A plurality of terminal pressing portion 57 is formed in a closed end surface of the insulating housing 50 with a specific distance in between in the connector width direction Y.

As shown in FIG. 21-1, the insulating housing 50 is provided with a mating side terminal 58 pressed fitted in the terminal pressing portion 57. A contact 58A of the mating side terminal 58 is positioned in the mating connector side engaging portion 52, and a lead portion 58B protrudes outside the closed end surface 50C.

Figure 17:
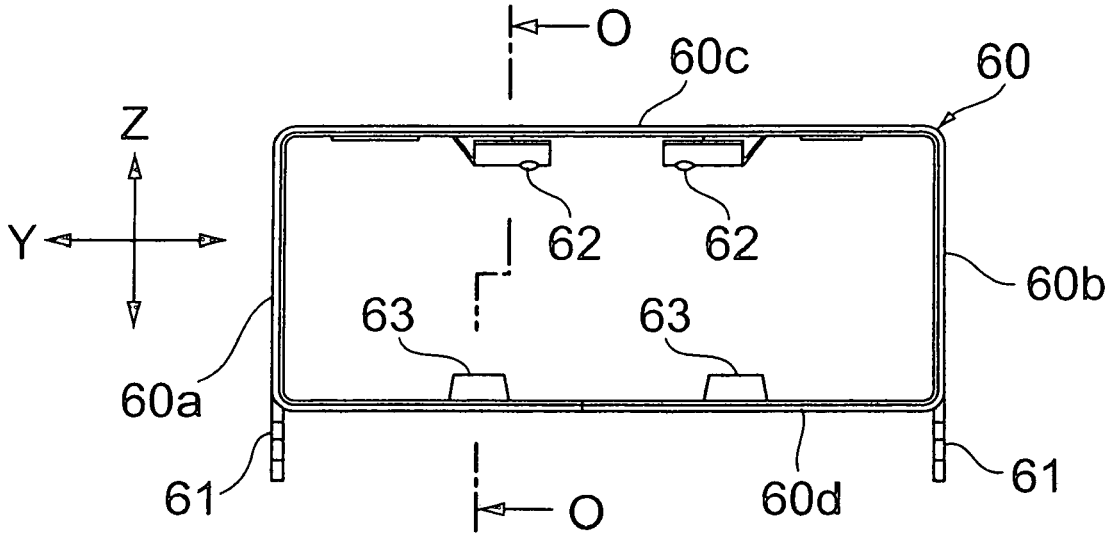
FIG. 17 is a front view showing a shield case of the board side connector.
Figure 18:
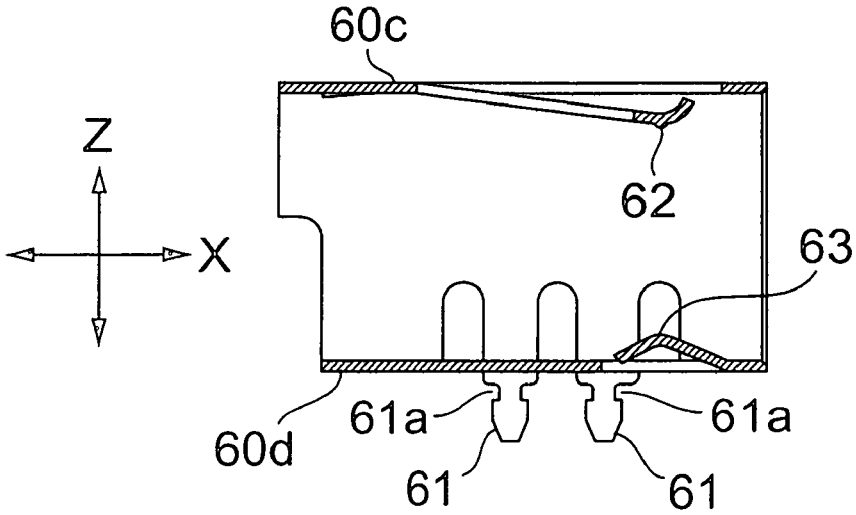
FIG. 18 is a sectional view taken along line 0—0 in FIG. 17.

As shown in FIG. 17 and FIG. 18, the shield case 60 is formed of a metal plate bent in a box shape, and both ends thereof in the connector insertion direction X are open. A pair of shield terminals 61 is formed at both side surfaces 60*a* and 60*b* in the connector width direction Y. The shield terminals 61 have narrow portions 61*a* at end portions thereof to have an arrow shape.

A shield contact portion 62 with a cantilever shape is formed on one edge surface 60*c* of the shield case 60 in the connector height direction Z along the connector insertion direction X. The shield contact portion 62 is inserted inside the shield case 60. A shield contact portion 63 with a cantilever shape is formed on the other edge surface 60*d* of the shield case 60 in the connector height direction Z toward the reversed direction of the shield contact portion 62. The shield contact portion 63 is inserted inside the shield case 60.

The shield case 60 covers the insulating housing 50. The shield contact portion 62 is inserted into the shield piece insertion opening 55, and the shield contact portion 63 is inserted into the shield piece insertion opening 56. The shield contact portions 62 and 63 are inserted into the mating connector side engaging portion 52 to form the board side connector B.

Figure 19:
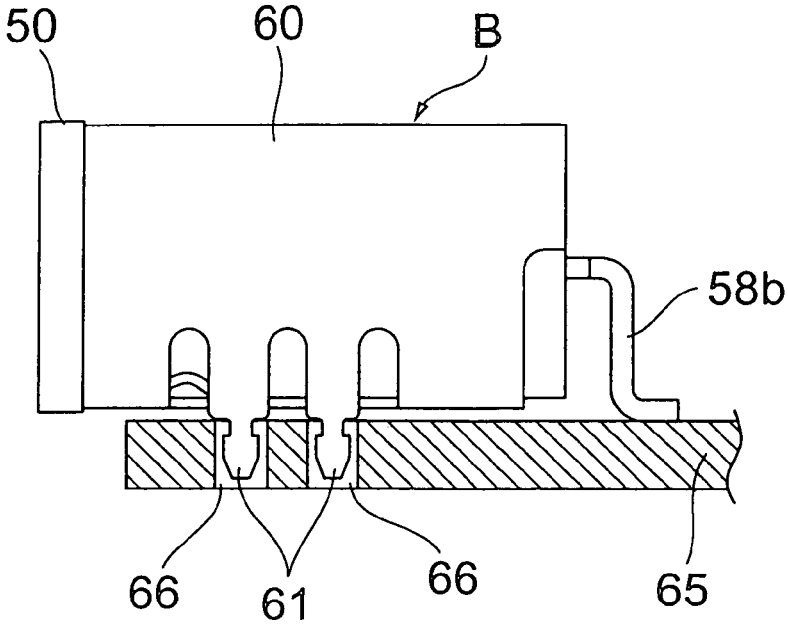
FIG. 19 is an explanatory view of mounting the board side connector on a print board.

As shown in FIG. 19, a lead portion 58*a* of the mating side terminal 58 is soldered to a circuit pattern (not shown) of a print board 65. The shield terminals 61 are inserted and soldered to through holes 66 of the print board 65, so that the board side connector B with the configuration described above is mounted on the print board 65. In the shield terminals 61, solder flows in the narrow portions 61, thereby strongly fixing.

A method of connecting and disconnecting the cable side connector A and the board side connector B will be explained next.

As shown in FIG. 21-1 and FIG. 21-2, a connector engaging portion A-1 of the cable side connector A is engaged with the mating connector side engaging portion 52 of the board side connector B. The lock portion 7 of the cable side connector A is inserted to engage the lock engaging portion 53 of the board side connector B. Accordingly, the cable side connector is connected to the board side connector B. When the lock portion 7 engages the lock engaging portion 53, after the lock lever 7A is inserted into the guide groove portion 53*a* of the lock engaging portion 53, the engaging portions 9 at both sides of the lock lever 7A engage the lock engaging portion 53*b*.

In this case, as shown in FIG. 21-2, the contacts 58A of the mating side terminals 58 of the board side connector B contact with a plurality of contact terminals 48 of the cable side connector A. Further, the shield contact portions 62 and 63 contact with the shield outer cylindrical portion 21 of the cable side connector A.

When the cable side connector A is disconnected from the board side connector B, the pressing portion 7B of the lock lever 7A is pressed with a finger to deform the lock lever 7A. Accordingly, the engaging portions 9 are released from the lock engaging portion 53*b*, so that the connector engaging portion A-1 of the cable side connector A is pulled out from the mating connector side engaging portion 52 of the board side connector B.

Figure 20:
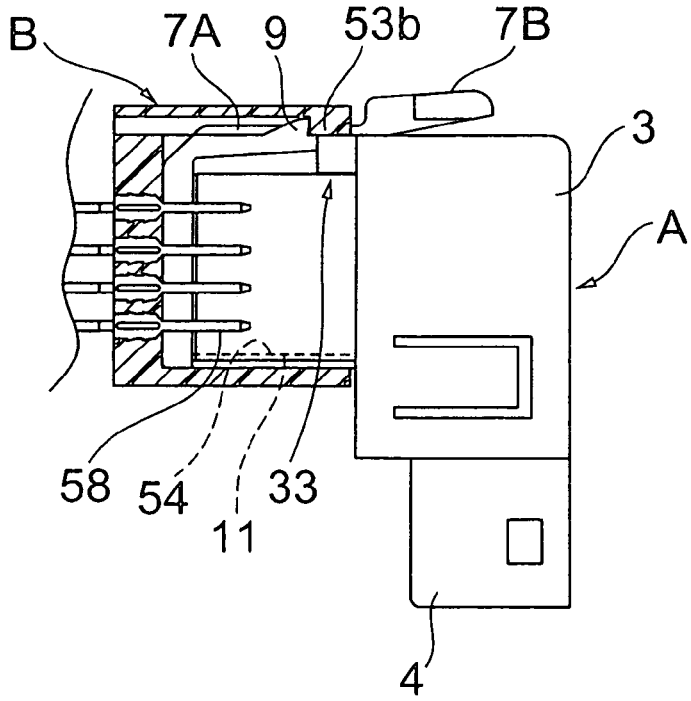
FIG. 20 is an explanatory view of a twisting of the cable side connector.

When the cable side connector A is connected to the board side connector B, the cable side connector A may be twisted to deform the lock lever 7A. As shown in FIG. 20, the projections 33 at both sides of the lock lever 7A abut against an inner surface of the mating connector side engaging portion 52, thereby preventing the lock lever 7A from deforming.

As described above, according to the embodiment of the present invention, the connector engaging portion A-1 of the cable side connector A is inserted into the shield outer cylindrical portion 21 of the shield member 2. The engaging projection 10 engages the engaging hole 26, and the guide groove portion 11 is inserted into the guide 21A. The contact terminals 41 are attached to the terminal attaching portions 5 of the connector housing 1, so that the contact terminals 41 engage the lances 8. Accordingly, the exposed portion 1B of the connector housing 1 protrudes from the end of the shield outer cylindrical portion 21, so that the exposed portion 1B and the shield outer cylindrical portion 21 constitute the connector engaging portion A-1. Therefore, as compared with the conventional connector in which the terminal unit covered with the shield is inserted into the connector housing to constitute the mating connector side engaging portion, it is possible to reduce the number of parts and a size of the connector housing, thereby making it possible to reduce a whole size of the shield connector.

When the cable side connector A is connected to the board side connector B, the cable side connector A may be twisted, so that the lock lever 7 may be deformed. However, since the projections 33 positioned at the both sides of the lock lever 7A abut against the inner surface of the mating connector side engaging portion 52, thereby preventing the lock lever 7A from deforming.

The lead portion 58*a* of the mating side terminal 58 protruding from the mounting surface is soldered to the circuit pattern (not shown) of the print board 65. The shield terminals 61 are inserted and soldered to the through holes 66 of the print board 65, so that the board side connector B with the configuration described above is mounted on the print board 65. Accordingly, it is possible to contribute to the reduction in a whole size of the shield connector.

In the shield connector of the invention, the shield attaching portion is attached to the shield outer cylindrical portion, so that the connector housing is attached to the shield member to form the connector engaging portion. Further, the connector housing is provided with the lock means. Accordingly, as compared with the conventional connector in which the terminal unit covered with the shield is inserted into the connector housing to constitute the mating connector side engaging portion, it is possible to reduce the number of parts and a size of the connector housing, thereby making it possible to reduce a whole size of the shield connector. The shield connector is useful for connecting shield cables of electrical devices installed in an automobile and the like.

What is claimed is:

1. A shield connector, comprising:

a connector housing;

a contact terminal housed in said connector housing for contacting with a mating side terminal of a mating connector when a connector engaging portion is detachably engaged with a mating side engaging portion of the mating connector; and a shield member, wherein said shield member has a shield outer cylindrical portion and a cable side shield portion covered with a case for covering an end portion of a cable to be connected to the contact terminal;

said case is provided with a lock lever insertion opening and a pair of projections disposed at an entrance side of the lever insertion opening;

said lock means is provided with a lock lever with a cantilever shape;

said connector housing has a shield attaching portion and lock means;

when the shield attaching portion is inserted into the shield outer cylindrical portion, the connector housing is attached to the shield member to form the connector engaging portion;

when connected to the mating connector, the lock means is detachably engaged with a lock portion of the mating connector; and when the connector housing is attached to the shield member, the lock lever is inserted into the lock lever insertion opening and the projections are positioned at both sides of the lock lever, and when connected to the mating connector, the projections are inserted into the mating connector side engaging portion to be situated at an inner surface of the mating connector side engaging portion.

2. The shield connector according to claim 1, wherein said shield attaching portion is attached to the shield outer cylindrical portion;

said contact terminal is attached to the terminal attaching portion of the connector housing;

said shield member is attached to the connector housing;

said shield member is formed of a shield portion, a cover portion, a bent portion at a middle portion between the shield portion and the cover portion, and a pressing portion connected to the cover portion;

said case includes a case side shield engaging recess portion and a retainer engaging portion;

said retainer includes a retainer side shield engaging recess portion;

said pressing portion presses in a state that the shield cable is retained in the cover portion so that the shield cable is attached to the shield member;

said bent portion is bent together with the shield cable by a substantially right angle relative to the shield outer cylindrical portion to engage the cover portion with the shield outer cylindrical portion;

said cable side shield portion engages the case side shield engaging recess portion; and said retainer engages the case so that the cable side shield portion is held with the retainer.

3. The shield connector according to claim 1, wherein said mating connector includes an insulating housing and a shield case covering the insulating housing;

said insulating housing includes the mating connector side engaging portion inside thereof and shield piece insertion openings formed in opposite surfaces thereof facing to each other;

said shield case has a box shape;

shield contacting portions protruding inside the shield case are formed on the opposite surfaces facing to each other; and said shield case covers the insulating housing and said shield contacting portions are inserted into the shield piece insertion openings to protrude into the mating connector side engaging portion so that a mating side terminal is positioned at the mating connector side engaging portion.

4. The shield connector according to claim 3, wherein shield terminals are formed on both side surfaces of the shield case in a connector width direction so that the shield case is directly mounted on a print board with the shield terminals.

5. The shield connector according to claim 1, wherein said mating connector includes an insulating housing and a shield case covering the insulating housing;

said insulating housing includes the mating connector side engaging portion inside thereof and shield piece insertion openings formed in opposite surfaces thereof facing to each other;

said shield case has a box shape;

shield contacting portions protruding inside the shield case are formed on the opposite surfaces facing to each other; and said shield case covers the insulating housing and said shield contacting portions are inserted into the shield piece insertion openings to protrude into the mating connector side engaging portion so that a mating side terminal is positioned at the mating connector side engaging portion.

6. The shield connector according to claim 5, wherein shield terminals are formed on both side surfaces of the shield case in a connector width direction so that the shield case is directly mounted on a print board with the shield terminals.

7. A shield connector, comprising:

a connector housing;

a contact terminal housed in said connector housing for contacting with a mating side terminal of a mating connector when a connector engaging portion is detachably engaged with a mating side engaging portion of the mating connector; and a shield member, wherein said shield member has a shield outer cylindrical portion and a cable side shield portion covered with a case and a retainer for covering an end portion of a cable to be connected to the contact terminal;

said connector housing has a shield attaching portion and lock means;

when the shield attaching portion is inserted into the shield outer cylindrical portion, the connector housing is attached to the shield member to form the connector engaging portion;

when connected to the mating connector, the lock means is detachably engaged with a lock portion of the mating connector;

said shield attaching portion is attached to the shield outer cylindrical portion;

said contact terminal is attached to the terminal attaching portion of the connector housing;

said shield member is attached to the connector housing;

said shield member is formed of a shield portion, a cover portion, a bent portion at a middle portion between the shield portion and the cover portion, and a pressing portion connected to the cover portion;

said case includes a case side shield engaging recess portion and a retainer engaging portion;

said retainer includes a retainer side shield engaging recess portion;

said pressing portion presses in a state that the shield cable is retained in the cover portion so that the shield cable is attached to the shield member;

said bent portion is bent together with the shield cable by a substantially right angle relative to the shield outer cylindrical portion to engage the cover portion with the shield outer cylindrical portion;

said cable side shield portion engages the case side shield engaging recess portion; and said retainer engages the case so that the cable side shield portion is held with the retainer.

8. The shield connector according to claim 7, wherein said mating connector includes an insulating housing and a shield case covering the insulating housing;

said insulating housing includes the mating connector side engaging portion inside thereof and shield piece insertion openings formed in opposite surfaces thereof facing to each other;

said shield case has a box shape;

shield contacting portions protruding inside the shield case are formed on the opposite surfaces facing to each other; and said shield case covers the insulating housing and said shield contacting portions are inserted into the shield piece insertion openings to protrude into the mating connector side engaging portion so that a mating side terminal is positioned at the mating connector side engaging portion.

9. The shield connector according to claim 8, wherein shield terminals are formed on both side surfaces of the shield case in a connector width direction so that the shield case is directly mounted on a print board with the shield terminals.

* * * * *